US010124613B2

(12) United States Patent
Ferrari

(10) Patent No.: US 10,124,613 B2
(45) Date of Patent: Nov. 13, 2018

(54) PRINTING UNIT FOR A PRINTING APPARATUS AND PRINTING APPARATUS COMPRISING SAID PRINTING UNIT

(71) Applicant: JET-SET S.R.L., Rovato (IT)

(72) Inventor: Sergio Ferrari, Ponte San Pietro (IT)

(73) Assignee: Jet-Set S.R.L., Imola (BO) (IT)

( * ) Notice: Subject to any disclaimer, the term of this patent is extended or adjusted under 35 U.S.C. 154(b) by 0 days.

(21) Appl. No.: 15/275,071

(22) Filed: Sep. 23, 2016

(65) Prior Publication Data

US 2017/0087904 A1 Mar. 30, 2017

(30) Foreign Application Priority Data

Sep. 25, 2015 (IT) ..... 1020150055539

(51) Int. Cl.

| | |
|---|---|
| ***B41J 25/00*** | (2006.01) |
| ***B41J 2/01*** | (2006.01) |
| ***B41J 2/155*** | (2006.01) |
| ***B41J 2/21*** | (2006.01) |
| ***B41J 25/34*** | (2006.01) |

(52) U.S. Cl.

CPC ..... *B41J 25/001* (2013.01); *B41J 2/01* (2013.01); *B41J 2/155* (2013.01); *B41J 2/2146* (2013.01); *B41J 25/34* (2013.01)

(58) Field of Classification Search

CPC .. B41J 2202/20; B41J 2202/14; B41J 19/145; B41J 25/001; B41J 25/308

See application file for complete search history.

(56) References Cited

U.S. PATENT DOCUMENTS

| | | | | |
|---|---|---|---|---|
| 6,241,334 | B1 * | 6/2001 | Haselby | B41J 2/2135 347/19 |
| 6,341,845 | B1 * | 1/2002 | Scheffelin | B41J 2/155 347/42 |
| 2005/0083364 | A1 * | 4/2005 | Billow | B41J 2/2135 347/19 |
| 2005/0243146 | A1 * | 11/2005 | Essen | B41J 2/145 347/84 |
| 2010/0002051 | A1 * | 1/2010 | Yoshimura | B41J 2/15 347/40 |
| 2010/0289854 | A1 * | 11/2010 | Hagiwara | B41J 2/155 347/44 |
| 2012/0044296 | A1 * | 2/2012 | Gouch | B41J 2/155 347/40 |

* cited by examiner

*Primary Examiner* — John P Zimmermann
(74) *Attorney, Agent, or Firm* — Baker & Hostetler LLP

(57) ABSTRACT

Printing unit comprising at least a printing head, a support plate to which said printing head is associated, and at least one positioning member associated to the support plate and to the printing head to adjust the reciprocal position of the latter two; the support plate defines an adjustment plane with respect to which the printing head is positioned; the positioning member comprises at least an actuation device which can be selectively actuated above the adjustment plane and a kinematic conversion device configured to convert the actuation of said actuation device into an adjustment of the position of the printing head with respect to the support plate in at least one direction lying on the adjustment plane; the actuation device is associable with a cam element able to engage in a suitably shaped seating made in the printing head.

10 Claims, 6 Drawing Sheets

PRINTING UNIT FOR A PRINTING APPARATUS AND PRINTING APPARATUS COMPRISING SAID PRINTING UNIT

CROSS REFERENCE TO RELATED APPLICATIONS

This application claims priority under 35 U.S.C. § 119 from Italian Patent Application No. 102015000055539, filed on Sep. 25, 2015 with the Italian Patents and Trademarks Office, Italy, the contents of which are incorporated herein by reference.

TECHNICAL FIELD

The present invention concerns a printing unit for a printing apparatus, and the corresponding printing apparatus that comprises the printing unit.

BACKGROUND

Printing apparatuses are known, of the laser or inkjet type for example, for printing on substrates such as paper, cardboard, polymer sheets or panels, tiles, posters or suchlike, substrates used in the most various fields, for example also medical, and on different types of materials of the substrate, generally comprising one or more printing units installed above a slider and a support plane, for example a belt, a plane or a mat, in which an article to be printed is positioned and possibly made to advance, in cooperation with the printing unit.

A plurality of printing heads are installed on the printing units, each of which is provided with delivery nozzles disposed reciprocally in a coordinated manner, in order to carry out the correct printing sequence with the pre-set materials and colors.

The printing head can also be provided, or cooperate, with a drying device, normally a UV lamp or other similar or comparable device, to dry the print material at the end of the corresponding cycle substantially instantaneously.

Each of the printing heads allows to deliver a color, for example the primary colors (cyan, magenta and yellow), the neutral colors (black and white), as well as possible specific materials in order to confer, for example, shiny/opaque effects or to deposit additives such as glitter.

It is known that printing heads are generally supported by a support plate on which they are attached in a precise position to perform the printing correctly.

In fact, a precise and reciprocal positioning of the printing heads is required so that they are correctly aligned with each other, or located parallel with each other, and/or are disposed so that the respective delivery nozzles are located one in continuation of the other, avoiding the presence of zones or lines comprised in the print area of the apparatus, not covered by the ink, or zones where there is an overlapping of deposited print material.

The precision positioning of the printing heads can be obtained mechanically or with electronic adjustment devices.

With regard to mechanical adjustment, an extremely precise working of the support plate is required, with accurate working tolerances, to define reference or abutment planes for the precise positioning of the individual printing heads. The reference or abutment planes are made in coordinated manner on the printing heads too. This solution, however, is extremely expensive and is not usually used, because it is not very reliable and has little possibility of achieving high precision.

Electronic adjustment modes do not allow very sophisticated and precise adjustments either, so that they are adopted only in fields where precision is not so important, for example where water ink printers are used, or where printing occurs for example on a substrate like ceramic.

On the contrary, in fields where print precision is fundamentally important, such as for example in UV printing, considerably more precise and accurate adjustment systems must be used.

In addition, electronic adjustment systems of the linear type are known, that is, which allow to perform translations of the printing heads with respect to the support plate, but do not allow for example an angular adjustment.

It is also known that in the state of the art there are a posteriori adjustment modes, that is, where the printing heads adapt to the position during their use, but a priori adjustment systems do not exist, that is, where the position of the printing heads is imparted before the printing operations.

It is also known that the printing unit can be moved vertically toward/away from the belt or mat to position the printing heads at the correct distance from the support or from the article to perform the printing.

Each printing unit can perform one, two or more successive printing cycles. As the printing cycles increase, so does the definition of the printed image.

A typical disadvantage of known solutions is due to the fact that if there is a need to perform maintenance and/or replacement of a printing module, the whole printing unit must be replaced.

Another disadvantage found in known printing apparatuses is that, to perform even minor operations, such as adjustments of the printing heads or removing a printing module for replacement, it is necessary to use a qualified technician or person of skill in the art, for example the technical assistant of the printing apparatus, making these operations expensive and causing long machine downtimes.

Another disadvantage is that, since the adjustment that can be made on the printing heads once the printing apparatuses have been assembled is minimal, the operations to produce and obtain their constituent parts must be very accurate and with minimum tolerances, thus making the mechanical workings very difficult, long and excessively expensive.

Another disadvantage is that in the state of the art printing apparatuses are made which are bulky in size and of considerable weight.

There is therefore a need to perfect a printing apparatus that can overcome at least one of the disadvantages of the state of the art.

In particular, one purpose of the present invention is to supply a new printing unit and the corresponding printing apparatus, of the laser or inkjet type for example, in order to print on substrates, which allows to adjust, precisely and reliably, the position of at least one printing head.

Another purpose of the present invention is to obtain a printing unit in which the position of the printing head can be adjusted quickly and easily by operators for example limiting or preventing the removal of components of the printing apparatus.

Another purpose of the present invention is to obtain a printing unit in which the printing head can be adjusted even by non-specialized personnel.

Another purpose is to obtain a printing unit and the corresponding printing apparatus that allow to make precise, defined, well performed and quick prints.

Another purpose of the present invention is to obtain a printing unit and the corresponding printing apparatus that comprises the printing unit which are long-lasting and economical.

One purpose of the present invention is to obtain a printing unit and the corresponding printing apparatus that are compact.

Another purpose of the present invention is to obtain a printing unit and the corresponding printing apparatus that are reliable and reduce the required maintenance operations.

The Applicant has devised, tested and embodied the present invention to overcome the shortcomings of the state of the art and to obtain these and other purposes and advantages.

SUMMARY

The present invention is set forth and characterized in the independent claims, while the dependent claims describe other characteristics of the invention or variants to the main inventive idea.

In accordance with the above purposes, a printing unit comprises at least a printing head, a support plate to which the printing head is associated, and at least one positioning member associated to the support plate and to the printing head to adjust the reciprocal position of the latter two.

According to one aspect of the present invention the support plate defines an adjustment plane with respect to which the printing head is positioned and the positioning member comprises at least an actuation device which can be selectively actuated above the adjustment plane and a kinematic conversion device configured to convert the actuation of the actuation device into an adjustment of the position of the printing head with respect to the support plate in at least one direction lying on the adjustment plane.

The actuation device is associable with a cam element able to engage in a suitably shaped seating made in the adjustment head.

The actuation device and the cam element are reciprocally associable by means of a screw-female screw coupling.

The cam element can be made for example using a suitably shaped block, but it can also have other embodiments able to allow that there is an adjustment of the printing head in at least one adjustment direction after the actuation device has been driven.

This solution allows to obtain an extremely precise adjustment of the position of the printing head compared to known solutions and is easily accessible by operators to carry out the necessary adjustments.

The positioning of the actuation device above the adjustment plane also allows to contain the overall bulk of the printing unit and therefore of the printing apparatus to which it is connected.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF ILLUSTRATIVE EMBODIMENTS

Figure 1:
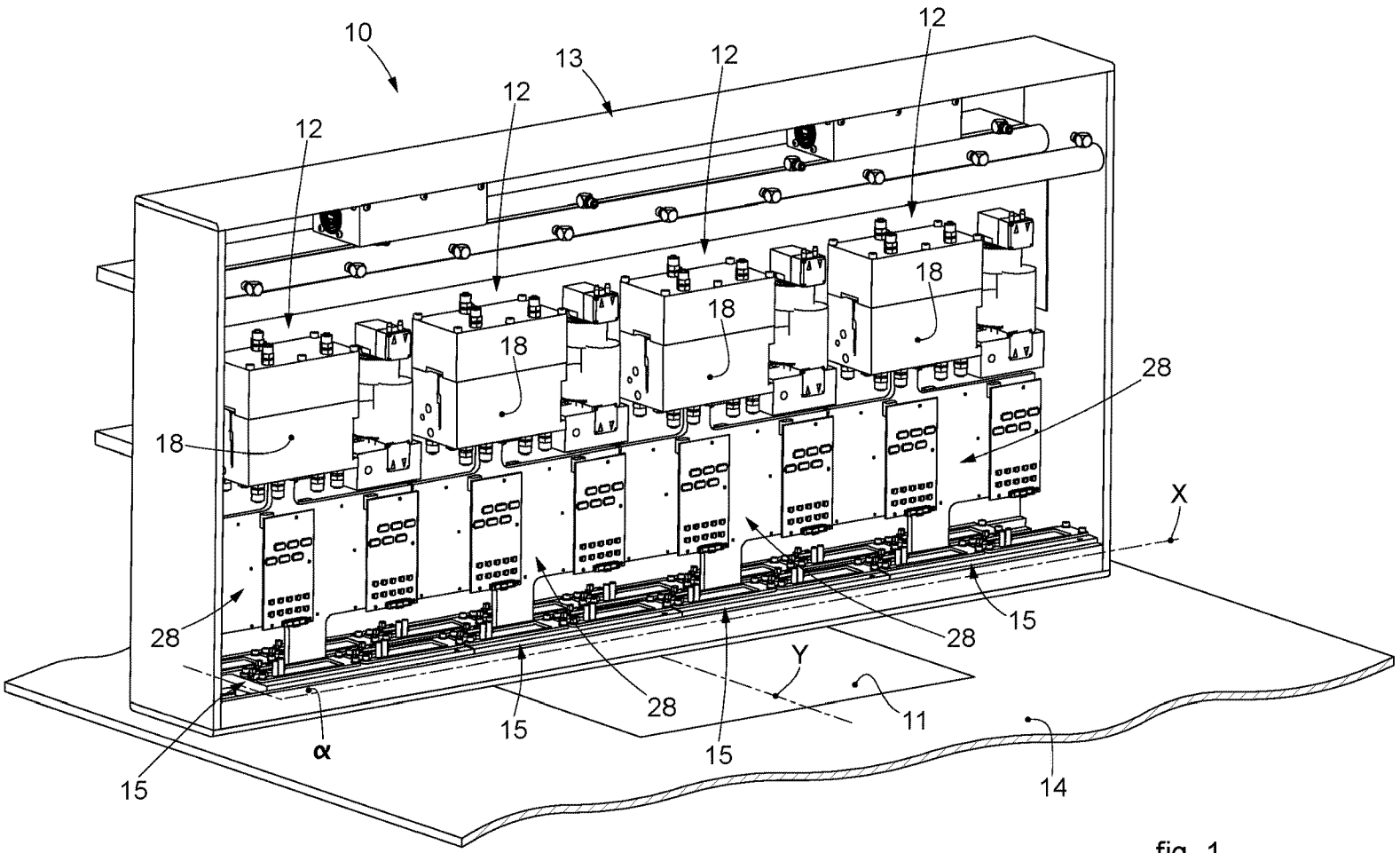
FIG. 1 is an overall perspective view of a printing apparatus comprising a plurality of printing units in accordance with embodiments described here.

A printing apparatus according to the present invention is indicated in its entirety in FIG. 1 by the reference number 10, and can be the laser or inkjet type, for printing substrates 11 in a direction of printing Y, such as paper, cardboard, polymer sheets or panels, tiles, posters or suchlike, substrates used in the medical field, and on different types of materials of the substrate 11.

Embodiments of the present invention provide that the printing apparatus 10 comprises one or more printing units 12, in FIG. 1 four printing units 12.

The printing units 12 can be disposed aligned along an axis X, transverse, for example perpendicular, to the direction of printing Y of the substrate 11 that is subjected to printing.

The printing apparatus 10 can comprise a support plane 14, for example a movement belt, plane or mat, on which the substrate 11 to be printed can be positioned and possibly moved.

The printing units 12 are located above the support plane 14 to perform the printing operations.

The printing units 12, or printing unit 12 if there is only one printing unit 12, are in turn installed on a support structure 13 located above the support plane 14.

The support structure 13 or support plane 14, or both, can be reciprocally mobile in the direction of printing Y to perform the printing operations.

One possible solution can provide that the support plane 14 is provided with feed devices, not shown in the drawings, configured to allow to feed the support plane 14 and hence the substrate 11 disposed on it, during the printing process, in the direction of printing Y.

According to a possible solution, the support structure 13 can be movable toward/away from the support plane 14, for example vertically, to be positioned at the correct distance from the substrate 11 to be printed.

The support structure 13 can in turn be installed on a frame, not shown, that keeps the support structure 13 above the support plane 14.

The printing unit 12 can comprise one or more printing heads 20 installed on a support plate 15.

The support plate 15 is in turn installed in a predetermined position on the support structure 13 as described hereafter.

According to some embodiments, there can be a single support plate 15 for all the printing heads 20 of all the printing units 12, or each printing unit 12 is provided with its own support plate 15 on which the printing head 20 is installed, or the printing heads 20 of the unit.

The support plate 15 defines an adjustment plane α to adjust the position of the printing heads 20.

The adjustment plane α can be located during use substantially parallel to the support plane 14 and hence to the substrate 11.

According to a possible solution of the present invention, the printing unit 12 comprises at least one positioning member, in this case shown in FIGS. 3*a*, 3*b*, 4, 5, 6*a*, 6*b*, 7*a* and 7*b*, a first positioning member 45*a* and a second positioning member 45*b*, associated with the support plate 15 and the printing head 20 to adjust the position of the printing head 20 with respect to the support plate 15.

The first positioning member 45*a* and the second positioning member 45*b* each comprise at least an actuation device 50, able to be selectively actuated above the adjustment plane α and a kinematic conversion device 46 configured to convert the actuation of the actuation device 50 into an adjustment of the position of the printing head 20 with respect to the support plate 15 in at least one direction lying on the adjustment plane α.

This possibility of adjusting the position is advantageous for compensating possible misalignments of the printing heads 20 due to irregularities in the mechanical workings performed to produce at least the support plate 15 and the printing heads 20.

According to the solution shown in FIGS. 3*a*, 3*b*, 4, 5, 6*a*, 6*b*, 7*a* and 7*b*, the first positioning member 45*a* is configured to perform an adjustment of the position of the printing head 20 in a first adjustment direction M and the second positioning member 45*b* is configured to perform an adjustment of the position of the printing head 20 in a second adjustment direction R, different from the first adjustment direction M. The first adjustment direction M and the second adjustment direction R both lie on the adjustment plane α.

According to a possible solution, the first adjustment direction M and/or the second adjustment direction R can be chosen from a group comprising a translation or a rotation.

Figure 5:
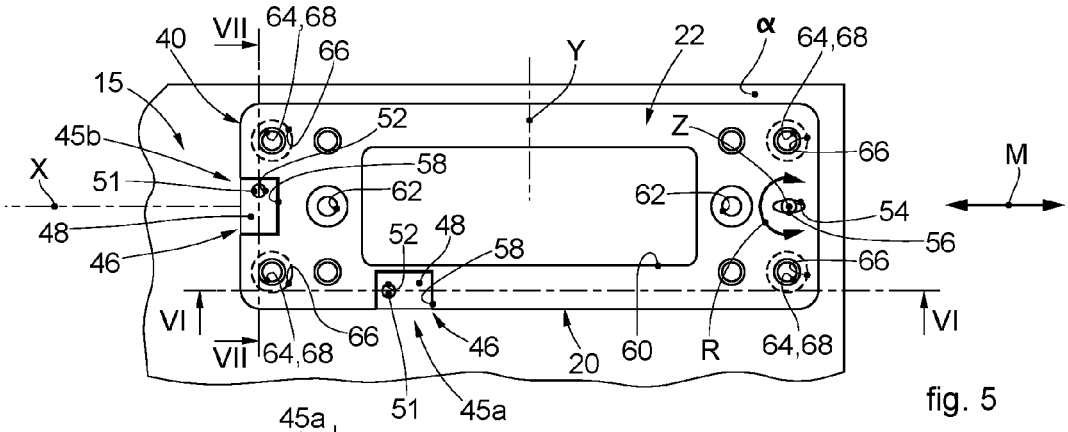
FIG. 5 is a view from above of a part of a printing unit.

According to a possible solution, shown for example with reference to FIG. 5, the first adjustment direction M comprises a translation in a direction transverse to the direction of printing Y.

According to a possible solution, the second adjustment direction R comprises a rotation of the printing head 20 on the adjustment plane α.

According to a possible solution of the present invention, the printing head 20 and the support plate 15 are provided respectively with an eyelet 54 and a pin 56, or vice versa, positioned in the eyelet 54. The eyelet 54 and the pin 56 are configured to allow a translation in the first adjustment direction M and a rotation in the second adjustment direction R of the printing head 20 with respect to the support plate 15.

According to the embodiment shown in FIG. 5, the eyelet 54 is made in the printing head 20, while the pin 56 is attached to the support plate 15.

The eyelet 54 extends in a direction parallel to the first adjustment direction M.

In particular, during the adjustment operations, it is provided that the printing head 20 is moved so that the pin 56 can both slide in the eyelet 54, determining a translation of the printing head 20 in the first adjustment direction M, and can also rotate around the eyelet 54, determining a rotation of the printing head 20 in the second adjustment direction R.

According to the embodiment shown in FIG. 5, the first positioning member 45*a* is disposed in correspondence with a first lateral edge of the printing head 20, while the second positioning member 45*b* is disposed in correspondence with a second lateral edge of the printing head 20 located transverse with respect to the first lateral edge.

According to a possible solution, shown for example in FIGS. 6*a*, 6*b*, 7*a* and 7*b*, the actuation device 50 has an actuation axis Z that is incident against the adjustment plane α.

According to the solution shown in FIGS. 6*a*, 6*b*, 7*a* and 7*b*, the actuation device 50 can be driven in rotation around the actuation axis Z, and the kinematic conversion device 46 is configured to convert the rotational motion received from the actuation device 50 into a positioning motion of the printing head 20 lying on the adjustment plane α.

According to some embodiments, the actuation device 50 is connected to the support plate 15 and to the kinematic conversion device 46. In this way the support plate 15 supplies a reference point for the movement of the printing head 20 with respect to the support plate 15.

According to the solution shown in FIGS. 6*a*, 6*b*, 7*a* and 7*b*, the actuation device 50 comprises a screw 51 installed on the support plate 15, rotatable around the actuation axis Z and constrained in translation along the actuation axis Z.

The screw 51 is in turn connected to the kinematic conversion device 46.

According to a possible solution shown in FIGS. 6*a*, 6*b*, 7*a* and 7*b*, the kinematic conversion device 46 comprises a cam element, for example a shaped block 48, connected to the actuation device 50, and at least an abutment wall of a seating 58 made in the frame 22 of the printing head 20 and configured to cooperate with the shaped block 48 so that an adjustment of the position of the printing head 20 on the adjustment plane α corresponds to a movement of the shaped block 48.

According to a possible solution, it can be provided that the abutment wall of the seating 58 is disposed inclined by an angle other than 90° with respect to the adjustment plane α and that the shaped block 48 is able to move sliding and resting along the abutment wall of the seating 58.

According to variant embodiments, the actuation device 50 is configured to move the shaped block 48 linearly along an axis parallel to the actuation axis Z, moving it perpendicular to the adjustment plane α of the printing heads 20.

According to variant embodiments, the shaped block 48 can have the form of a prism with a parallelogram base, in which the inclined sides are disposed resting on the abutment wall of the seating 58.

According to other embodiments described using FIG. 5, the shaped block 48 can comprise a hole 52 into which the screw 51 of the actuation device 50 is screwed.

By screwing or unscrewing the screw 51 it is possible to move the shaped block 48 linearly along the actuation axis Z. The linear movement of the shaped block 48, in cooperation with the abutment wall of the seating 58, determines a movement of the printing head 20 with respect to the support plate 15 on the adjustment plane α.

The support plate 15 can comprise cavities 70 configured to collaborate with the kinematic conversion device 46, for example to house the shaped block 48.

According to a possible variant embodiment, not shown in the drawings, it can be provided that the actuation device 50 comprises a screw 51 substantially analogous to that described above and that the kinematic conversion device 46 is defined only by an abutment wall of the seating 58 made in the printing head 20, inclined by an angle other than 90° with respect to the adjustment plane α, and on which the terminal end of the screw 51 is made to thrust. The vertical movement of the screw 51, due to its screwing/unscrewing, and the cooperation of the terminal end of the screw 51 with the abutment wall of the seating 58 made in the printing head 20 allows to obtain the movement of the latter with respect to the support plate 15 and on the adjustment plane α.

Due to the cooperation between the first positioning member 45*a*, the eyelet 54 and the pin 56, it is possible to perform a translation of the printing head 20 with respect to the support plate 15.

Figure 6A:
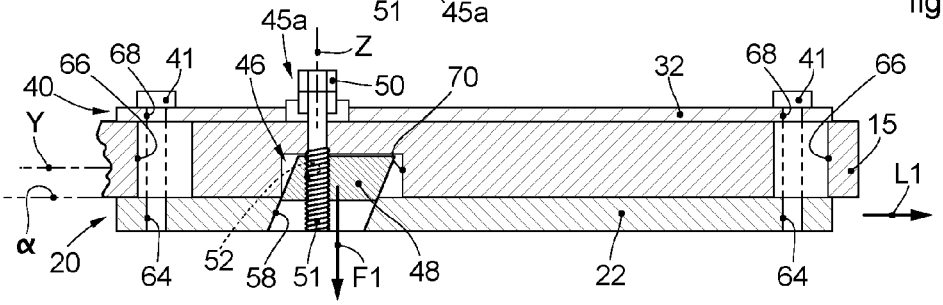
FIG. 6*a* is a cross section from VI to VI in FIG. 5 in a first operating condition.

By activating the actuation element 50, the shaped block 48 is made to move along an axis parallel to the actuation axis Z in the direction of arrow F1 (see FIG. 6*a*). Due to the interference between the shaped block 48 and the abutment wall of the seating 58, a movement is determined of the printing head 20 in the direction of arrow L1 which corresponds to a translation with respect to the axis X, concordant with arrow M.

Figure 6B:
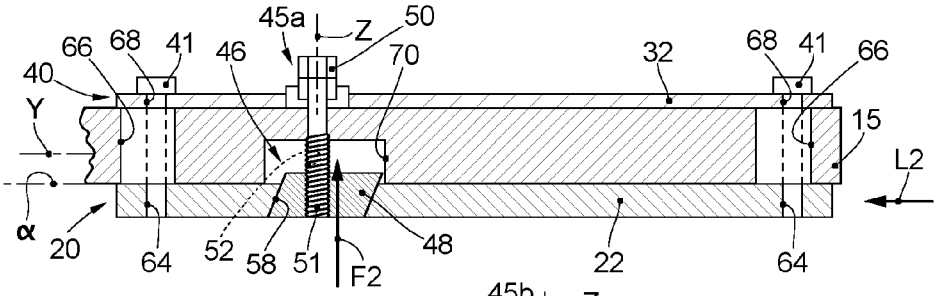
FIG. 6*b* is a cross section from VI to VI in FIG. 5 in a second operating condition.

According to variant embodiments described using FIGS. 5 and 6*b*, in the same way, the shaped block 48 can be inside the abutment wall of the seating 58, determining a second limit position of the printing head 20 with respect to the support plate 15.

By activating the actuation element 50, in the direction opposite to the previous one, the shaped block 48 is made to move along an axis parallel to the actuation axis Z in the direction of arrow F2. Due to the interference between the shaped block 48 and the abutment wall of the seating 58, a movement is determined of the printing head 20 in the direction of arrow L2 which corresponds to a translation with respect to the axis X, in the opposite direction to the previous one, concordant with arrow M.

In the same way, due to the cooperation between the second positioning member 45*b*, the eyelet 54 and the pin 56, it is possible to perform, on the contrary, a rotation and translation of the printing head 20 with respect to the support plate 15.

Figure 7A:
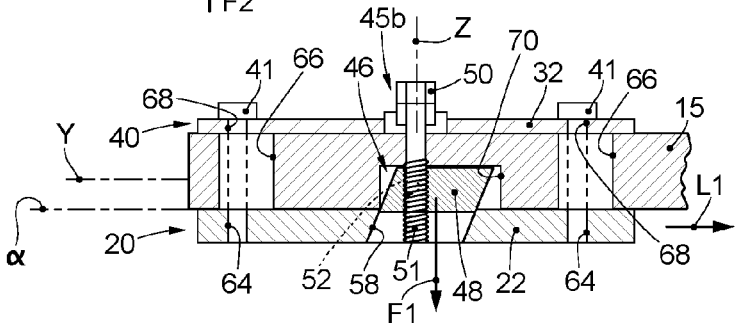
FIG. 7*a* is a cross section from VII to VII in FIG. 5 in a first operating condition.

According to variant embodiments described using FIGS. 5 and 7*a*, the shaped block 48 can be inside the cavity 70, determining a first limit position of the printing head 20 with respect to the support plate 15.

By activating the actuation element 50, the shaped block 48 is made to move along an axis parallel to the actuation axis Z in the direction of arrow F1. Due to the interference between the shaped block 48 and the abutment wall of the seating 58, a movement is determined of the printing head 20 in the direction of arrow L1 which corresponds to a rotation of the printing head 20 with respect to the pin 56, concordant with the second adjustment direction R.

Figure 7B:
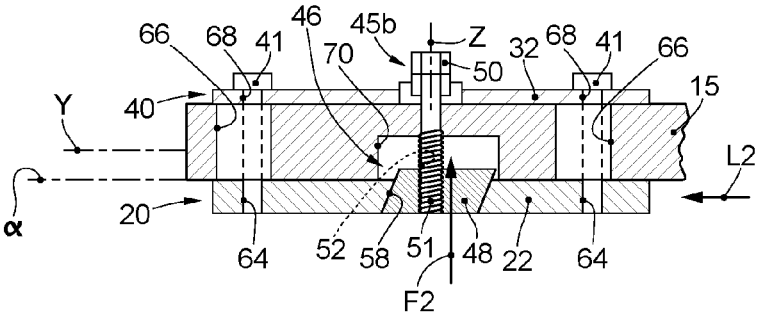
FIG. 7*b* is a cross section from VII to VII in FIG. 5 in a second operating condition; and, FIG. 8 is an enlarged perspective view of a detail of a printing apparatus in accordance with embodiments described here.

By activating the actuation element 50, in the direction opposite to the previous one, the shaped block 48 is made to move along an axis parallel to the actuation axis Z in the direction of arrow F2 (see FIG. 7*b*). Due to the interference between the shaped block 48 and the abutment wall of the seating 58, a movement is determined of the printing head 20 in the direction of arrow L2 which corresponds to a rotation of the printing head 20 with respect to the pin 56 in the opposite direction to the previous one, concordant with the second adjustment direction R.

In both the positioning members 45*a* and 45*b*, the actuation element or device 50 and the shaped block 48 therefore form a screw-female screw coupling that allows the shaped block 48 to be translated in one direction or the other.

The shaped block 48 in turn behaves like a cam element when the actuation element 50 is activated. In fact, the translation of the shaped block 48, provided for example in the positioning member 45*a*, along the abutment walls of the seating 58 of the printing head 20, determines the movement of the printing head 20 in the adjustment direction M.

Using the positioning member 45*b*, in the same way and thanks to the corresponding cam element represented by the shaped block 48, it is possible to adjust the printing head 20 in the adjustment direction R.

The seating 58 made in the frame 22 of the printing head 20 can comprise two suitably inclined abutment walls.

The abutment walls of the seating 58 are parallel to each other.

The shaped block 48, as can easily be understood, represents one of the multiple cam elements that could be used in the positioning member 45*a* and/or 45*b* to determine the movement of the printing head 20 in one or more adjustment directions following the activation of the corresponding actuation elements or devices 50.

According to possible solutions of the present invention, between the printing head 20 and the support plate 15 holding devices 40 are provided, configured to hold the printing head 20 resting on the support plate 15 and to prevent a movement in an incident direction with respect to the adjustment plane α.

According to the embodiment shown in FIGS. 6*a*, 6*b*, 7*a* and 7*b*, the holding devices 40 comprise threaded elements 41 installed in through holes 66 made in the support plate 15 and configured to screw into threaded holes 64 made in the printing head 20.

The printing heads 20 can be provided with a print dispenser 21 and a frame 22 configured to allow to connect the print dispenser 21 to the support plate 15.

According to possible variant embodiments, the print dispenser 21 and the frame 22 could also be made in a single body.

Figure 2:
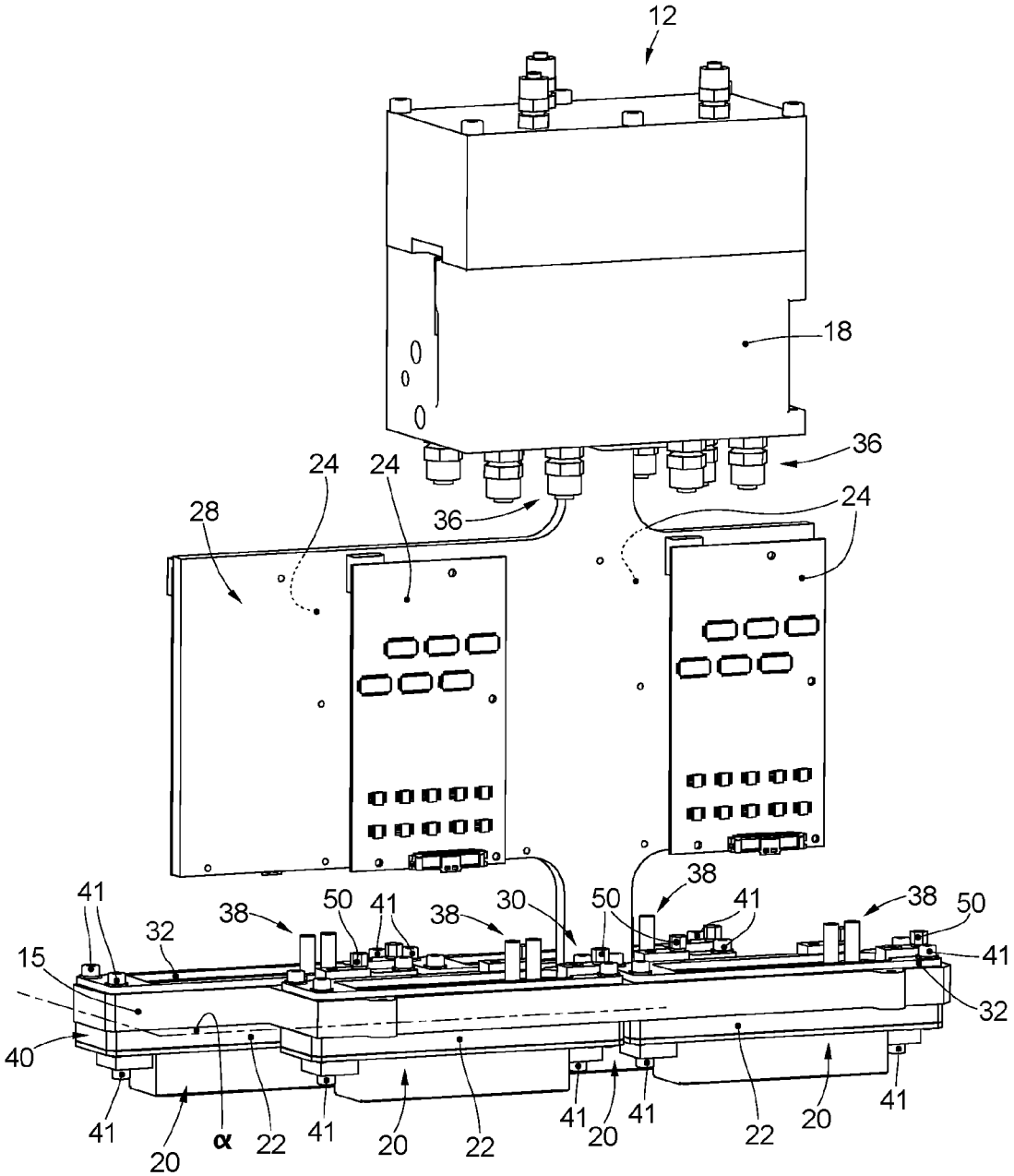
FIG. 2 is a perspective view of a printing unit in accordance with embodiments described here.
Figure 3A:
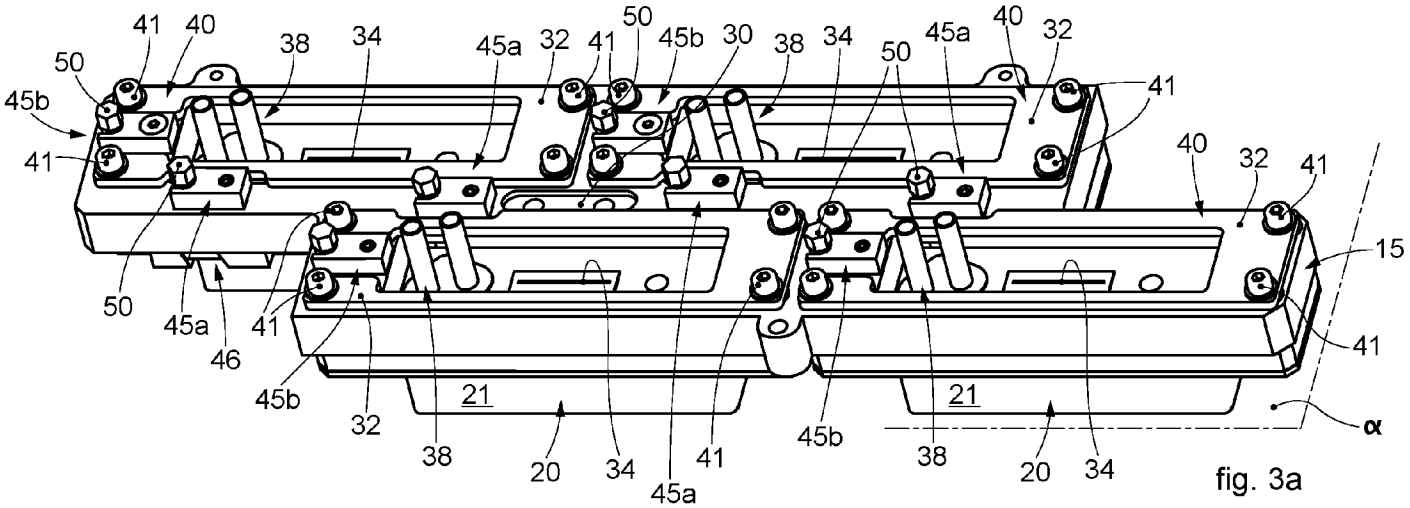
FIG. 3*a* is a perspective view from above of part of a printing unit in accordance with embodiments described here.
Figure 3B:
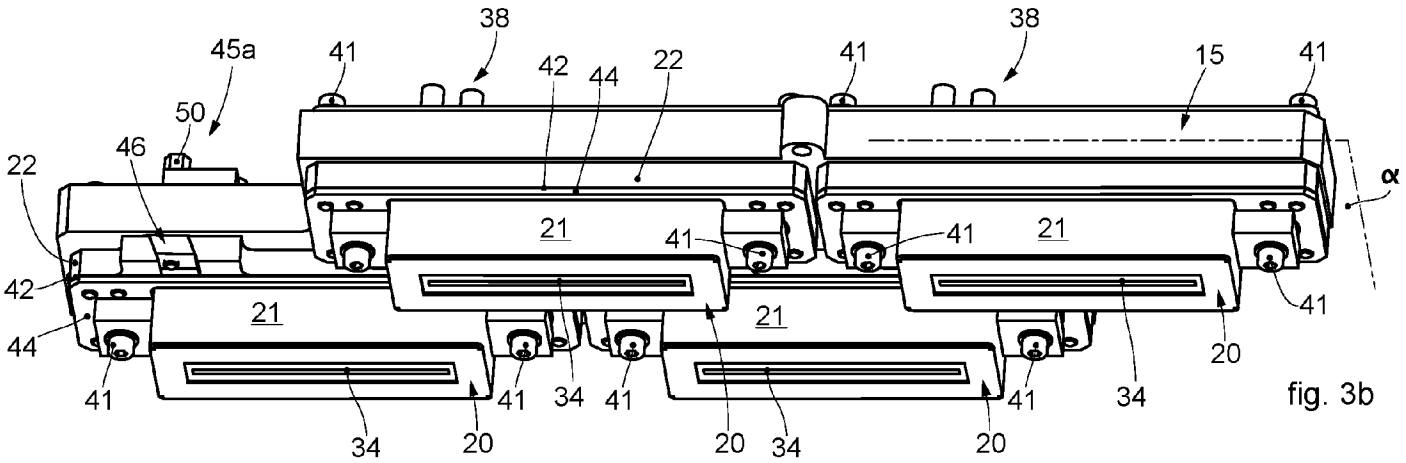
FIG. 3*b* is a perspective view from below of FIG. 3*a;*

According to variant embodiments described using FIGS. 2, 3*a* and 3*b*, the holding devices 40 can comprise a counter-frame 32 configured to allow to connect the frame 22 and hence the print dispenser 21 to the corresponding support plate 15.

The counter-frame 32 can be disposed on the opposite side of the support plate 15 with respect to the one where the frame 22 and the print dispenser 21 are disposed, therefore, during use, frame 22 and print dispenser 21 face toward the substrate 11, while the counter-frame 32 is on the opposite side, which faces upward and is more easily accessible for an operator who wants to make an adjustment.

Frame 22 and counter-frame 32 can be associated with the support plate 15 by constraining them with attachment elements, in this case the same threaded elements 41 described above. In this way it is possible to maintain and/or replace the printing heads 20 extremely easily.

According to possible embodiments described using FIG. 5, the frame 22 can comprise at least one attachment hole 62, preferably at least two attachment holes 62, configured to associate the printing head 20 with the respective frame 22 by holding devices 40.

According to possible embodiments, the frame 22 can comprise an aperture 60 configured for the passage of connections, not shown in the drawings, to the print dispenser 21.

According to variant embodiments described using FIGS. 5, 6*a*, 6*b*, 7*a* and 7*b*, the frame 22 can comprise holes 64.

According to variant embodiments described using FIGS. 5, 6*a*, 6*b*, 7*a* and 7*b*, the support plate 15 can have the through holes 66 mating with the holes 64.

According to variant embodiments, the counter-frame 32 comprises holes 68 mating with the holes 64 of the respective frame 22. The holes 64 and the corresponding holes 68 can be suitably aligned so as to be able to constrain the frame 22 to the support plate 15, once the desired position of one with respect to the other has been adjusted and obtained, by clamping the holding devices 40 onto the frame 22 and counter-frame 32.

The through holes 66 have cross section sizes greater than those of the holes 64, 68, thus allowing a possibility of moving the printing head 20 on the adjustment plane $\alpha$.

Figure 4:
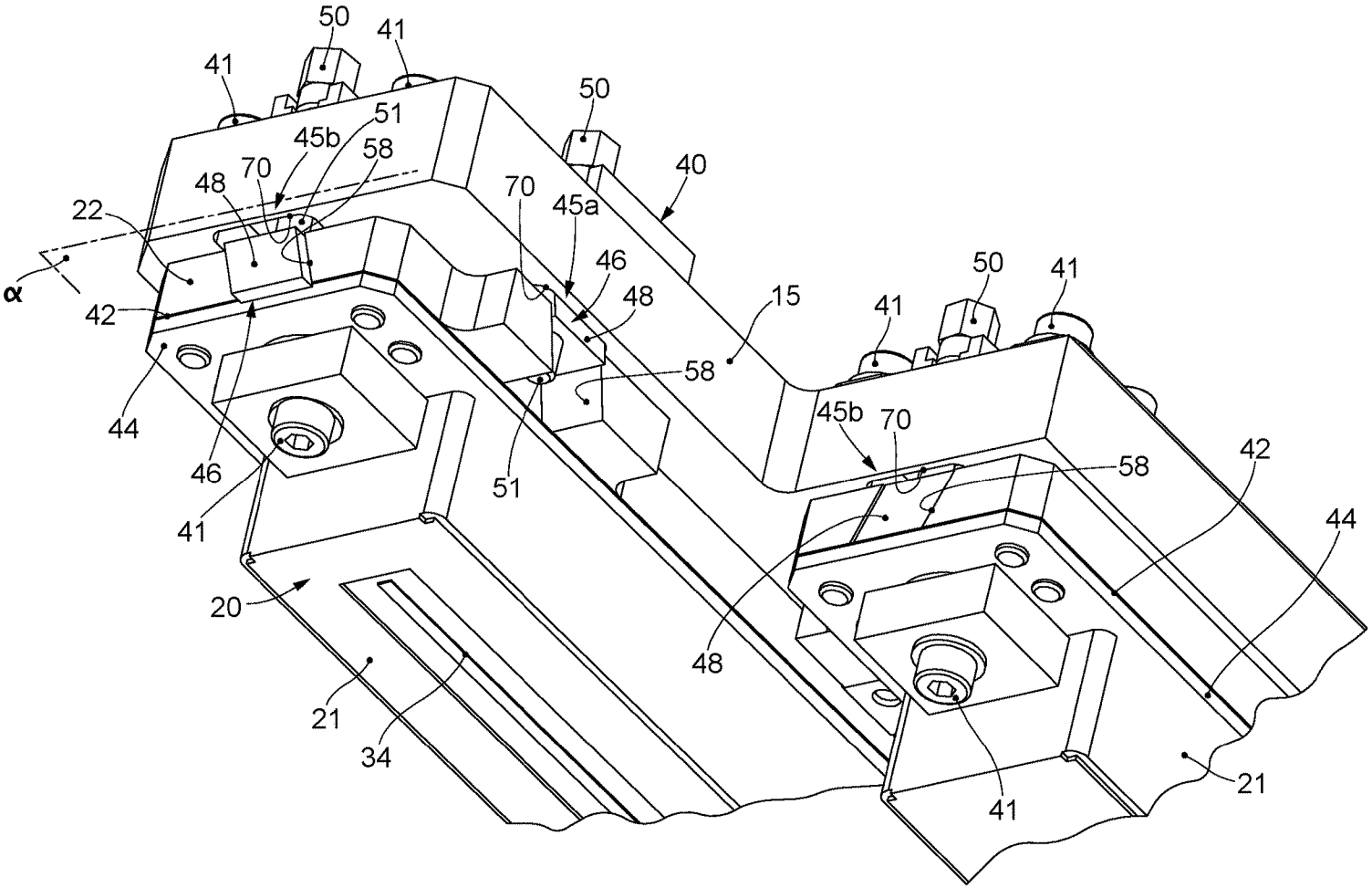
FIG. 4 is an enlarged perspective view of a part of a printing unit.

According to variant embodiments described using FIG. 4, each printing head 20 can comprise a compensation plate 42 installed between the print dispenser 21 and the corresponding frame 22. The compensation plate 42 can be made of brass for example or other suitable material.

According to other variant embodiments, each printing head 20 can also comprise a second compensation plate 44. The second compensation plate 44 can be installed for example between the print dispenser 21 and the compensation plate 42.

Each print dispenser 21 is provided with respective nozzles 34 configured to perform the correct printing sequence and to dispense the pre-set materials and colors.

The nozzles 34 must be correctly aligned in order to obtain a precise printing, defined and well-made on the substrate 11.

According to variant embodiments, each printing unit 12 can comprise one or more feed devices 18, suitable to supply an adequate quantity of print material, such as color, for example the primary colors (cyan, magenta and yellow), the neutral colors (black and white), as well as possible specific materials in order to confer, for example, shiny/opaque effects or also additives such as glitter, on the printing heads 20.

The feed devices 18 can comprise for example members to recirculate the print material in the printing heads 20.

The feed devices 18 can be connected to tanks that contain the print material suitable to make this available to the printing heads 20.

A respective control board 24 is associated with each printing head 20, provided to command the selective functioning of the printing head 20 and possibly of the feed devices 18.

Each printing head 20, the respective control board 24 and possibly the respective feed devices 18 together define a printing module 16.

Each printing unit 12 comprises at least one of the printing modules 16, preferably a plurality, for example two, three or as in the case shown in FIG. 1, each printing unit 12 comprises four printing modules 16.

According to one aspect of the present invention, in this way printing units 12 of a modular type are obtained, selectively installable/replaceable on the printing apparatus 10 quickly and easily, even by non-specialized staff.

According to variant embodiments described using FIGS. 1 and 2, the printing unit 12 can comprise a support board 28 configured to support and connect the respective printing modules 16.

The support plate 15 can comprise an electric connector 30. For the electric connection of the control boards 24 to the printing heads 20 it can be provided that the electric cables are made on the support board 28 and that the latter is connected to the electric connector 30.

The feed devices 18 can comprise entrance/exit connectors 36 configured to make the print material flow to the printing heads 20 and allow to recirculate excess print material.

In the same way, the printing heads 20 can comprise entrance/exit connectors 38 to supply print material to be deposited on the substrate 11.

According to possible embodiments, the printing modules 16 comprise connection elements such as thin tubes or pipes, not shown in the drawings, to supply print material from the tank 18 to the printing heads 20 and/or vice versa to recover print material from the printing heads 20 to the tank 18.

In possible solutions, the printing heads 20 can cooperate with a drying device, normally a UV lamp, not shown in the drawings, to dry the print material deposited on the substrate 11 substantially instantaneously.

Depending on the individual requirements, it is possible to align the printing heads 20 in a desired manner, simply and precisely with simple adjustment operations.

Figure 8:
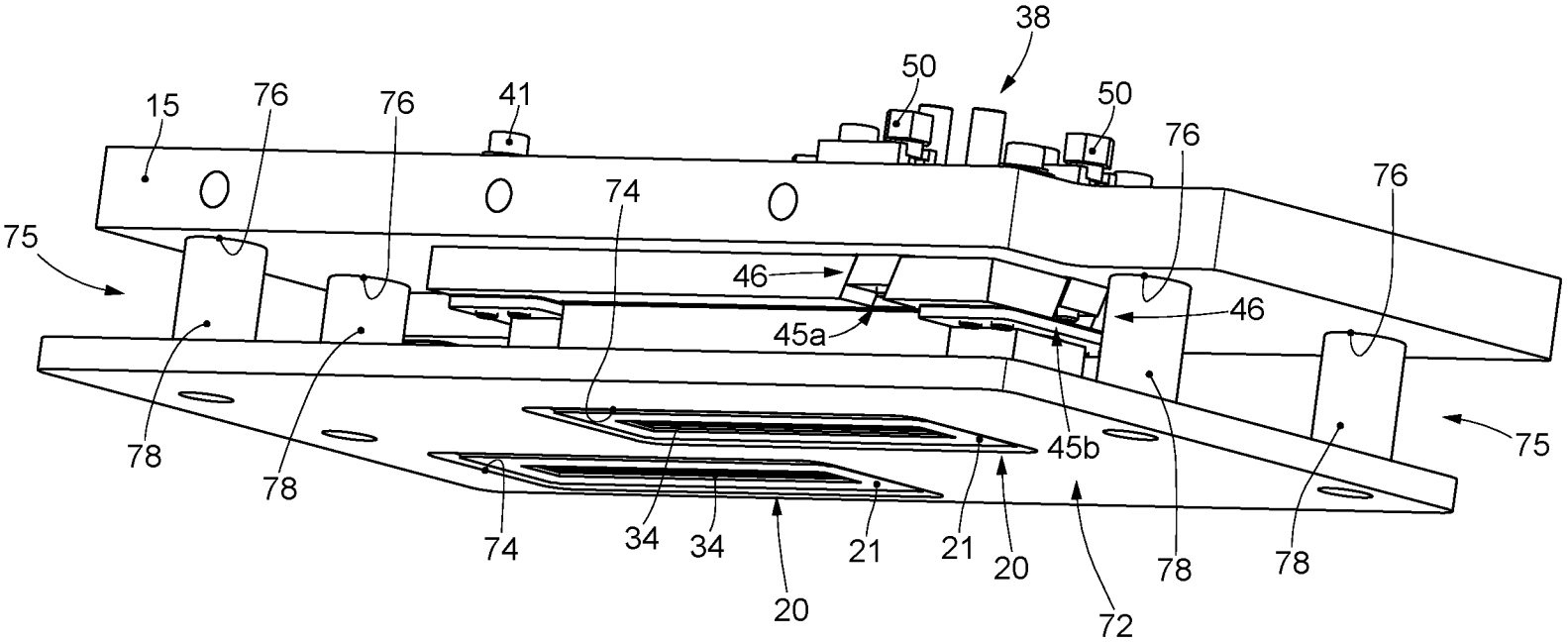

According to variant embodiments described using FIG. 8, the printing apparatus 10 can comprise a flat stabilizing plate 72 configured to surround the printing heads 20 and make the print surface uniform above the substrate 11 to be printed, so as to reduce possible turbulence deriving from the sliding of the latter. In this way it is possible to reduce turbulence that can be generated with the sliding of the substrate 11 and that deflects the print jet during deposition.

According to variant embodiments, the stabilizing plate 72 comprises housings 74, mating in shape with the printing heads 20, and in which, during use, the printing heads 20 are at least partly positioned through, in order to make the surface as uniform and flat as possible.

The stabilizing plate 72 and the support plates 15 can comprise reference elements 75 to maintain the desired position if one or more support plates 15 were to be replaced.

According to possible variant embodiments, the reference elements 75 can comprise eyelets 76 made in the stabilizing plate 72 and pins 78 protruding from the support plates 15, coordinated with the eyelets 76. It is obvious that the position of eyelets 76 and pins 78 can also be inverted or combined between the stabilizing plate 72 and the support plates 15.

It is clear that modifications and/or additions of parts may be made to the printing apparatus 10 as described heretofore, without departing from the field and scope of the present invention.

It is also clear that, although the present invention has been described with reference to some specific examples, a person of skill in the art shall certainly be able to achieve many other equivalent forms of printing apparatus 10, having the characteristics as set forth in the claims and hence all coming within the field of protection defined thereby.

What is claimed:

1. A printing unit, comprising:

at least a printing head;

a support plate to which said printing head is configured to associate;

wherein said support plate defines an adjustment plane with respect to which said printing head is positioned;

a first positioning member configured to associate with the support plate and the printing head and adjust the reciprocal position of the support plate and the printing head, the first positioning member being further configured to carry out an adjustment of the position of the printing head in a first adjustment direction, wherein said first adjustment direction comprises a translation of the printing head in a direction transverse to the direction of printing;

a second positioning member configured to associate with the support plate and the printing head and adjust the reciprocal position of the support plate and the printing head, the second positioning member being further configured to carry out an adjustment of the position of the printing head in a second adjustment direction, wherein said second adjustment direction comprises a rotation of said printing head on said adjustment plane, wherein said first adjustment direction and said second adjustment direction both lie on said adjustment plane;

wherein each positioning member comprises at least an actuation device configured to be selectively actuated above the adjustment plane, and wherein each positioning member further comprises a kinematic conversion device configured to convert the actuation of said actuation device into an adjustment of the position of the printing head with respect to the support plate in said at least two adjustment directions lying on the same adjustment plane; and wherein said actuation device is configured to associate with a cam element configured to engage in a suitably shaped seating made in said printing head.

2. The printing unit as in claim 1, wherein said actuation device and said cam element are configured to be reciprocally associated by means of a screw-female screw coupling.

3. The printing unit as in claim 1, wherein the printing head is provided with an eyelet and the support plate is provided with a pin, or the printing head is provided with a pin and the support plate is provided with an eyelet, wherein the pin is disposed in the eyelet, said eyelet and said pin being configured to allow a translation along the first adjustment direction and a rotation along the second adjustment direction of the printing head with respect to said support plate.

4. The printing unit as in claim 1, wherein said actuation device has an actuation axis that is incident against the adjustment plane.

5. The printing unit as in claim 3, wherein said actuation device is configured to be driven in rotation around the actuation axis, and said kinematic conversion device is configured to convert the rotational motion received from the actuation device into a positioning motion of the printing head lying on the adjustment plane.

6. The printing unit as in claim 1, wherein said cam element is configured to be associable with the actuation device and is configured to engage on at least one abutment wall of said seating made in said printing head such that an adjustment of the position of the printing head on the adjustment plane corresponds to a movement of the cam element.

7. The printing unit as in claim 4, wherein the actuation device is configured to move the cam element linearly along an axis parallel to the actuation axis, moving the cam element perpendicularly to the adjustment plane of the printing heads.

8. The printing unit as in claim 1, further comprising a holding device provided between the printing head and the support plate, the holding device configured to hold the printing head resting on the support plate and further configured to prevent a movement in a direction incident with respect to the adjustment plane.

9. A printing apparatus comprising at least one support plane configured to have positioned on it a substrate to be printed, further comprising a printing unit as in claim 1.

10. A printing method, comprising:

a step of adjusting the position of a printing head with respect to a support plate by means of a first positioning member configured to carry out the adjustment in a first adjustment direction and a second positioning member configured to carry out the adjustment in a second adjustment direction, wherein said support plate defines an adjustment plane with respect to which said printing head is positioned, and wherein during said adjustment step it is provided to drive an actuation device above the adjustment plane and, with a kinematic conversion device, to convert the actuation of said actuation device into an adjustment of the position of the printing head with respect to the support plate in at least one direction lying on the adjustment plane, said conversion being carried out by means of at least one cam element cooperating with the actuation device and with the printing head, wherein said first adjustment direction comprises a translation of the printing head in a direction transverse to the direction of printing, and said second adjustment direction comprises a rotation of said printing head on said adjustment plane, and wherein said first adjustment direction and said second adjustment direction both lie on said adjustment plane.

* * * * *